US007025559B2

(12) United States Patent
Loy et al.

(10) Patent No.: US 7,025,559 B2
(45) Date of Patent: Apr. 11, 2006

(54) METHODS AND SYSTEMS FOR OPERATING ROTARY MACHINES

(75) Inventors: David Forrest Loy, Ballston Lake, NY (US); Gregory Edward Cooper, Ballston Spa, NY (US); Steven Craig Kluge, Burnt Hills, NY (US); Dean Alexander Baker, Clifton Park, NY (US); Vivek Venugopal Badami, Schenectady, NY (US); Peter J. Eisenzopf, Altamont, NY (US)

(73) Assignee: General Electric Company, Schenectady, NY (US)

( * ) Notice: Subject to any disclaimer, the term of this patent is extended or adjusted under 35 U.S.C. 154(b) by 88 days.

(21) Appl. No.: 10/861,025

(22) Filed: Jun. 4, 2004

(65) Prior Publication Data

US 2005/0271499 A1 Dec. 8, 2005

(51) Int. Cl.
*F01D 1/00* (2006.01)

(52) U.S. Cl. ..... 415/1; 415/119; 416/39; 416/61; 416/44; 416/500

(58) Field of Classification Search ..... 415/119; 416/1, 39, 44, 61, 500; 700/287, 289
See application file for complete search history.

(56) References Cited

U.S. PATENT DOCUMENTS

| | | | | |
|---|---|---|---|---|
| 5,234,315 | A * | 8/1993 | Ogihara et al. | 415/16 |
| 5,311,562 | A | 5/1994 | Palusamy et al. | |
| 5,838,588 | A * | 11/1998 | Santoso et al. | 700/287 |
| 5,905,989 | A | 5/1999 | Biggs | |
| 6,421,571 | B1 | 7/2002 | Spriggs et al. | |
| 6,557,118 | B1 | 4/2003 | Schleiss et al. | |
| 6,615,090 | B1 | 9/2003 | Blevins et al. | |

* cited by examiner

*Primary Examiner*—Edward K. Look
*Assistant Examiner*—Devin Hanan
(74) *Attorney, Agent, or Firm*—Armstrong Teasdale LLP

(57) ABSTRACT

A method for operating a rotary machine is provided. The rotary machine includes a stationary member and a rotatable member wherein the rotatable member is configured to rotate at least partially within the stationary member. The method includes determining an off-normal operating condition of the rotary machine facilitating undesirable contact between the rotatable member and the stationary member, monitoring a parameter associated with the off-normal operating condition, and preventing operation of the rotary machine while the monitored parameter is within a predetermined range.

42 Claims, 6 Drawing Sheets

METHODS AND SYSTEMS FOR OPERATING ROTARY MACHINES

BACKGROUND OF THE INVENTION

The present invention relates generally to rotary machines, and, more particularly, to methods and apparatus to facilitate sealing between rotary and stationary components within a rotary machine.

Steam and gas turbines are used, among other purposes, to generate power for electric generators. Known steam turbines have a steam path that typically includes, in serial-flow relationship, a steam inlet, a turbine, and a steam outlet. Known gas turbines have a gas path which typically includes, in serial-flow relationship, an air intake (or inlet), a compressor, a combustor, a turbine, and a gas outlet (or exhaust nozzle). Compressor and turbine sections include at least one row of circumferentially spaced rotating blades or buckets.

Turbine efficiency depends at least in part on controlling a radial clearance or gap between the rotor shaft and the surrounding casing or outer shell. If the clearance is too large, steam or gas flow may leak through the clearance gaps, thus decreasing the turbine's efficiency. Alternatively, if the clearance is too small, the rotating packing seal teeth may undesirably contact the stationary packing seal or vice versa, during certain turbine operating conditions, thus adversely affecting the turbine efficiency. Gas or steam leakage, through the packing seals represents a loss of efficiency and is generally undesirable.

To facilitate minimizing seal leakage, at least some known turbines use a plurality of labyrinth seals. Known labyrinth seals include longitudinally spaced-apart rows of labyrinth seal teeth to facilitate sealing against pressure differentials that may be present in a turbine. However, certain off-normal operating conditions of the turbine may cause a flexure of the turbine casing, a bow in the rotor shaft, and other conditions that may cause the labyrinth seal teeth to contact other turbine components. Such contact, known as rubbing, may damage or distort the shape of the teeth and increase the clearance between the rotor and the casing such that the turbine thermal efficiency may be reduced. For example, temperature excursions during startup may distort turbine components, and result in the packing rubbing against the turbine shaft. Once the clearance between the shaft and the packing expands beyond original design specifications, efficiency losses due to steam leakage through the packing may increase. Generally, a damaged seal is only repairable or interchangeable during a turbine outage. Alternatives to known labyrinth seal designs may improve a seal's tolerance to rubs, however known designs may not be able to prevent rubs from occurring.

BRIEF DESCRIPTION OF THE INVENTION

In one embodiment, a method for operating a rotary machine is provided. The rotary machine includes a stationary member and a rotatable member wherein the rotatable member is configured to rotate at least partially within the stationary member. The method includes determining an off-normal operating condition of the rotary machine facilitating undesirable contact between the rotatable member and the stationary member, monitoring a parameter associated with the off-normal operating condition, and preventing operation of the rotary machine while the monitored parameter is within a predetermined range.

In another embodiment, a control system for optimizing turbine startup procedures is provided. The turbine includes a turbine having a turbine shell, and a rotor configured to rotate about a longitudinal axis at least partially within the shell, and a plurality of process sensors configured to monitor an off-normal operating condition of the turbine. The system includes a database for storing turbine design data relating to clearances between the rotor and the shell, and a processor having a memory storing a plurality of analytical tools wherein the processor is configured to be coupled to the plurality of process sensors and the database. The processor is further configured to determine an off-normal operating condition of the rotary machine wherein the off-normal operating condition facilitates undesirable contact between the rotatable member and the stationary member, monitors a parameter associated with the off-normal operating condition, and prevents operation of the rotary machine while the monitored parameter is within a predetermined range.

In a further embodiment, a computer program embodied on a computer readable medium for monitoring a plant is provided. The plant includes a plurality of equipment cooperating to supply steam to a steam driven rotary machine. The rotary machine includes a stationary member and a rotatable member wherein the rotatable member is configured to rotate at least partially within the stationary member. The computer program includes a code segment that controls a computer that receives a plurality of process parameters from sensors operatively coupled to the equipment and then determines an off-normal operating condition of the rotary machine wherein said off-normal operating condition facilitates undesirable contact between the rotatable member and the stationary member, monitors a parameter associated with the off-normal operating condition, and prevents operation of the rotary machine while the monitored parameter is within a predetermined range.

DETAILED DESCRIPTION OF THE INVENTION

Figure 1:
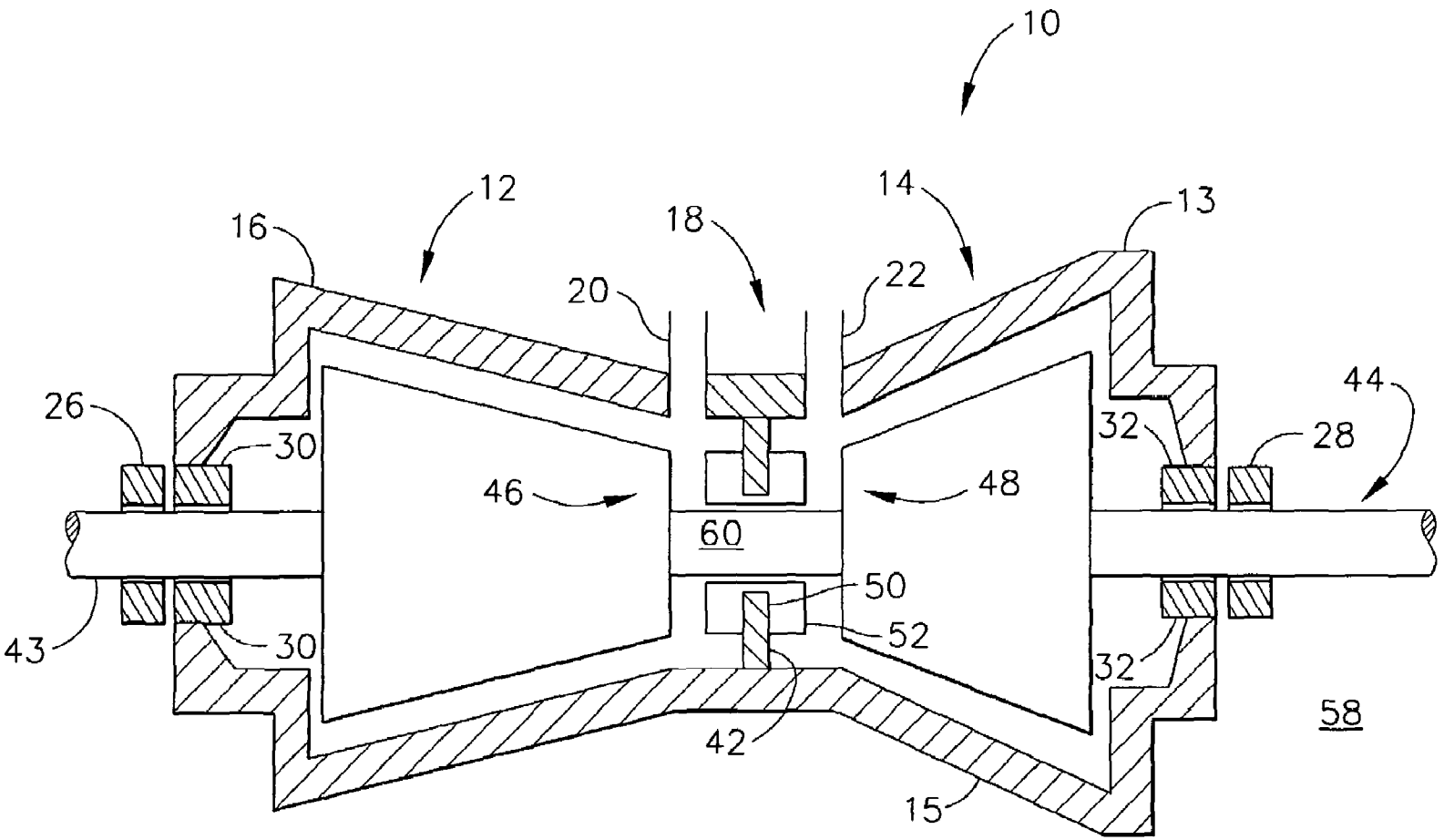
FIG. 1 is a cross-sectional view of an exemplary steam turbine.

FIG. 1 is a schematic illustration of an exemplary opposed-flow steam turbine 10 including a high pressure (HP) section 12 and an intermediate pressure (IP) section 14. An outer shell or casing 16 is divided axially into upper and lower half sections 13 and 15, respectively, and spans both HP section 12 and IP section 14. A central section 18 of shell 16 includes a high-pressure steam inlet 20 and an intermediate pressure steam inlet 22. HP section 12 and IP section 14 are housed within casing 16 and are arranged in a single bearing span supported by journal bearings 26 and 28. A shaft steam seal packing 30 and 32 is located inboard of each journal bearing 26 and 28, respectively.

An annular section divider 42 extends radially inwardly from central section 18 towards a rotor shaft portion 60 that extends between HP section 12 and IP section 14. More specifically, divider 42 extends circumferentially around a portion of rotor shaft portion 60 between a first HP section nozzle 46 and a first IP section nozzle 48. Divider 42 is received in a channel 50 defined in a shaft steam seal packing 52.

Axially inboard from journal bearings 26 and 28, shaft steam seal packing 30 and 32, respectively, may be utilized for reducing leakage from steam turbine 10 to ambient 58 around rotor shaft portions 43 and 44, respectively. Shaft steam seal packing 52 facilitates reducing steam leakage from relatively higher pressure HP section 12 to IP section 14. Each packing 30 and 32, and/or shaft steam seal packing 52 may be of the labyrinth seal type.

During operation, high-pressure steam inlet 20 receives high pressure/high temperature steam from a steam source, for example, a power boiler (not shown). Steam is routed through HP section 12 wherein work is extracted from the steam to rotate rotor shaft portions 43, 44, and 60. The steam exits HP section 12 and is returned to the boiler wherein it is reheated. Reheated steam is then routed to intermediate pressure steam inlet 22 and returned to IP section 14 at a reduced pressure than steam entering HP section 12, but at a temperature that is approximately equal to the temperature of steam entering HP section 12. Accordingly, an operating pressure within HP section 12 is higher than an operating pressure within IP section 14, such that steam within HP section 12 tends to flow towards IP section 14 through leakage paths that may develop between HP section 12 and IP section 14. One such leakage path may be defined extending through shaft steam seal packing 52 adjacent rotor shaft portion 60. Accordingly, shaft steam seal packing 52 includes a plurality of labyrinth seals to facilitate reducing leakage from HP section 12 to IP section 14 along rotor shaft portion 60.

In the exemplary embodiment, the labyrinth seals include longitudinally spaced-apart rows of labyrinth seal teeth, which facilitate sealing against operating pressure differentials that may be in a steam turbine. Brush seals may also be used to facilitate minimizing leakage through a gap defined between two components, such as leakage that is flowing from a higher pressure area to a lower pressure area. Brush seals provide a more efficient seal than labyrinth seals, however, at least some known steam turbines, which rely on a brush seal assembly between turbine sections and/or between a turbine section and a bearing, also use at least one standard labyrinth seal as a redundant backup seal for the brush seal assembly.

Figure 2:
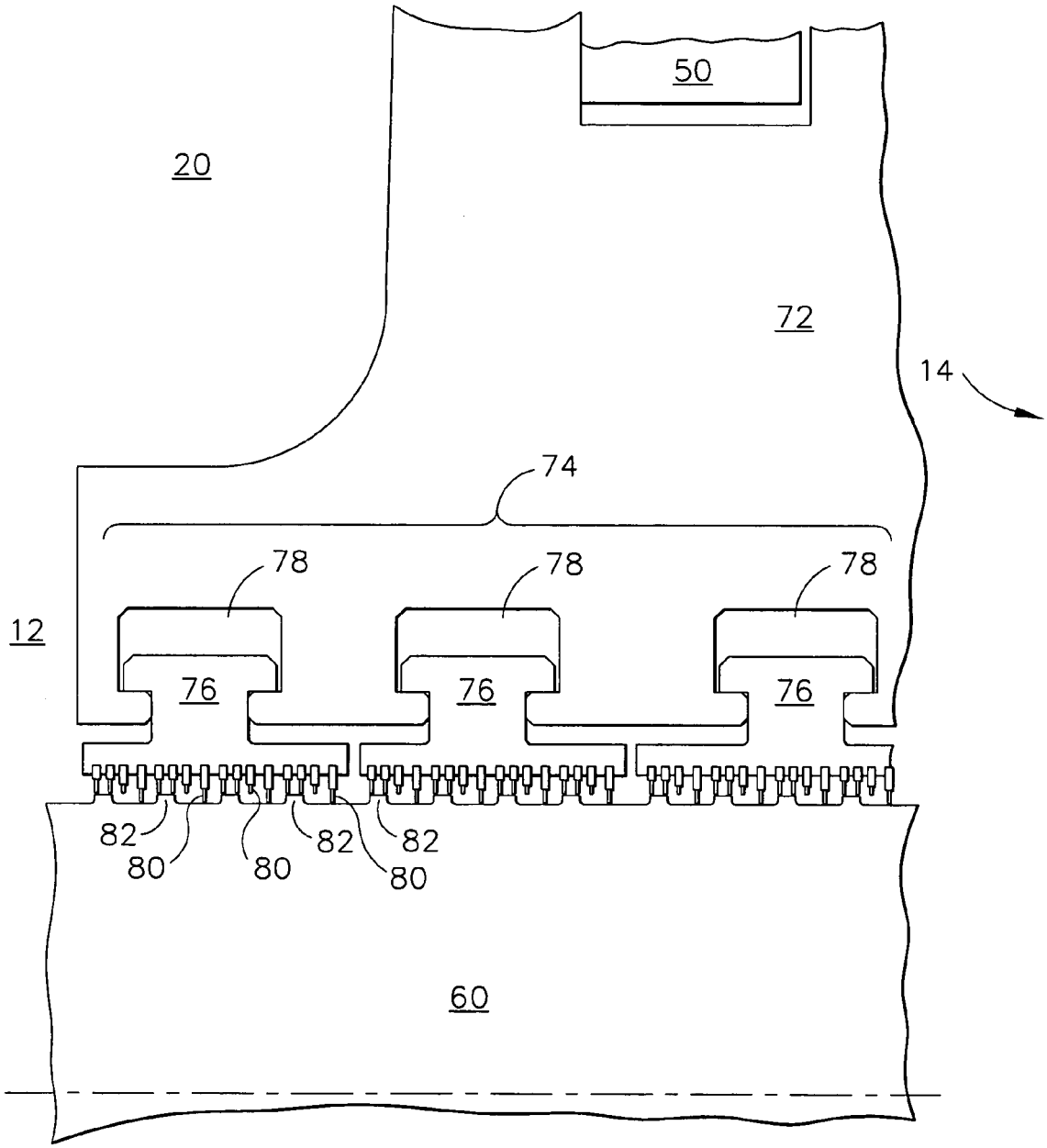
FIG. 2 is an enlarged schematic illustration of an HP section packing casing and a seal assembly, that may be used with the steam turbine shown in FIG. 1.

FIG. 2 is an enlarged schematic illustration of an HP section packing casing 72, and a seal assembly 74, that may be used in a steam turbine, such as steam turbine 10 (shown in FIG. 1). Seal assembly 74 is disposed between rotor shaft portion 60 and packing casing 72 between HP section 12 and IP section 14. Seal assembly 74 may include one or more packing rings 76 mounted in circumferentially extending grooves 78 in packing casing 72. Packing ring 76 includes a sealing means, such as a plurality of axially spaced labyrinth seal teeth 80 extending from packing ring 76. Packing sealing means can also include a brush seal (not shown) or a combination of axially spaced labyrinth seal teeth 80 and a brush seal. Rotor shaft portion 60 includes raised portions or teeth 82 that cooperate with teeth 80 to place a relatively large number of barriers, i.e., teeth 80 and 82, to the flow of fluid from a high pressure region to a low pressure region on opposite sides of seal assembly 74, with each barrier forcing the fluid to follow a tortuous path whereby leakage flow is reduced. The sum of the pressure drops across seal assembly 74 is by definition the pressure difference between the high and low pressure regions on axially opposite sides thereof. Packing ring 76 may be spring-backed and are thus free to move radially when subjected to severe rotor/seal interference.

Figure 3:
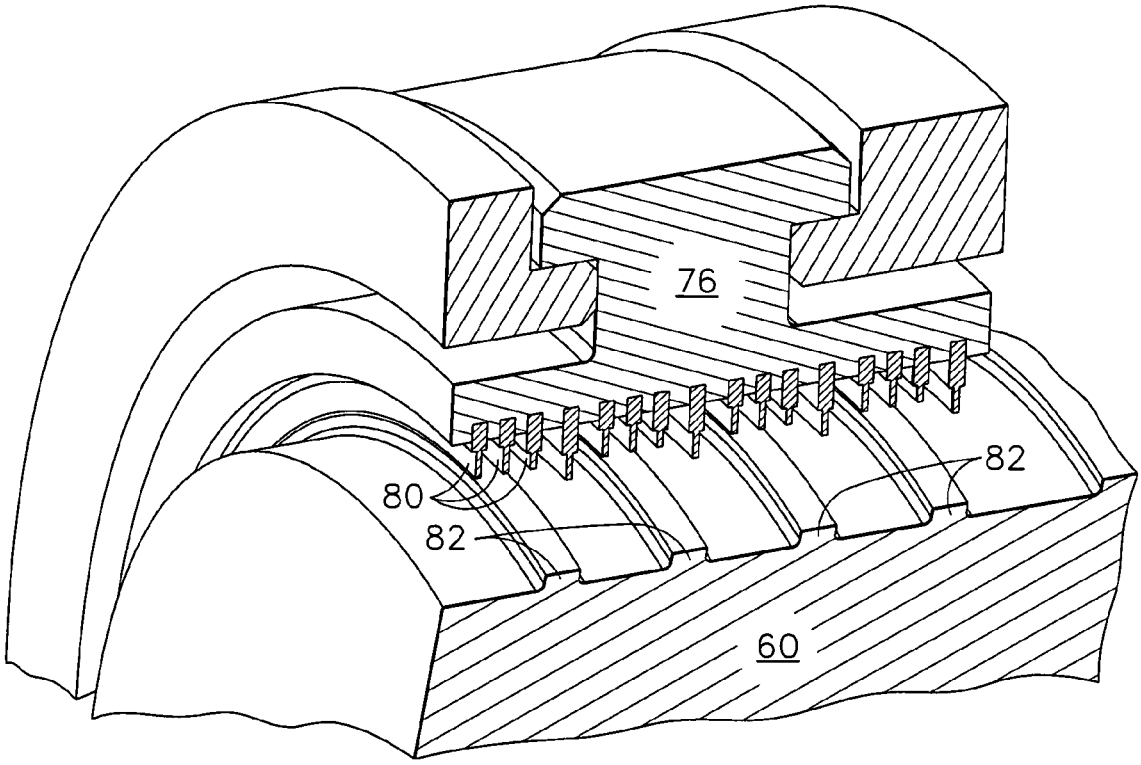
FIG. 3 is a perspective view of an exemplary packing ring that may be used with seal assembly shown in FIG. 2.

FIG. 3 is a perspective view of an exemplary packing ring 76 that may be used with seal assembly 74 (shown in FIG. 2). Labyrinth teeth 80 and teeth 82 intermesh when turbine 10 is assembled such that a relatively close clearance is defined between teeth 80 and teeth 82. Due to such close clearance, teeth 80 and 82 may be subject to contacting each other or other components during certain off-normal operating conditions of turbine 10. Most notably temperature-driven differential expansion of casing 16 during startup or shutdown of turbine 10. Such differential expansion may cause casing 16 to warp, such that portions of casing 16 are driven into contact with rotor shaft portions 43, 44 and 60.

Figure 4:
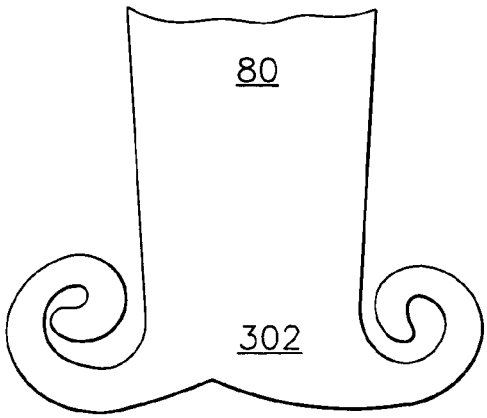
FIG. 4 is an enlarged view of one of the teeth that has contacted the rotor shaft portion.

FIG. 4 is an enlarged view 300 of one of teeth 80 that has contacted rotor shaft portion 60. A distal end 302 of tooth 80 is deformed into a mushroom shape resulting in an enlargement of the clearance between tooth 80 and rotor shaft portion 60. Additionally, such a geometry may cause tooth 80 to behave similarly to a nozzle and increase leakage flow beyond what just a loss of material would cause.

Figure 5:
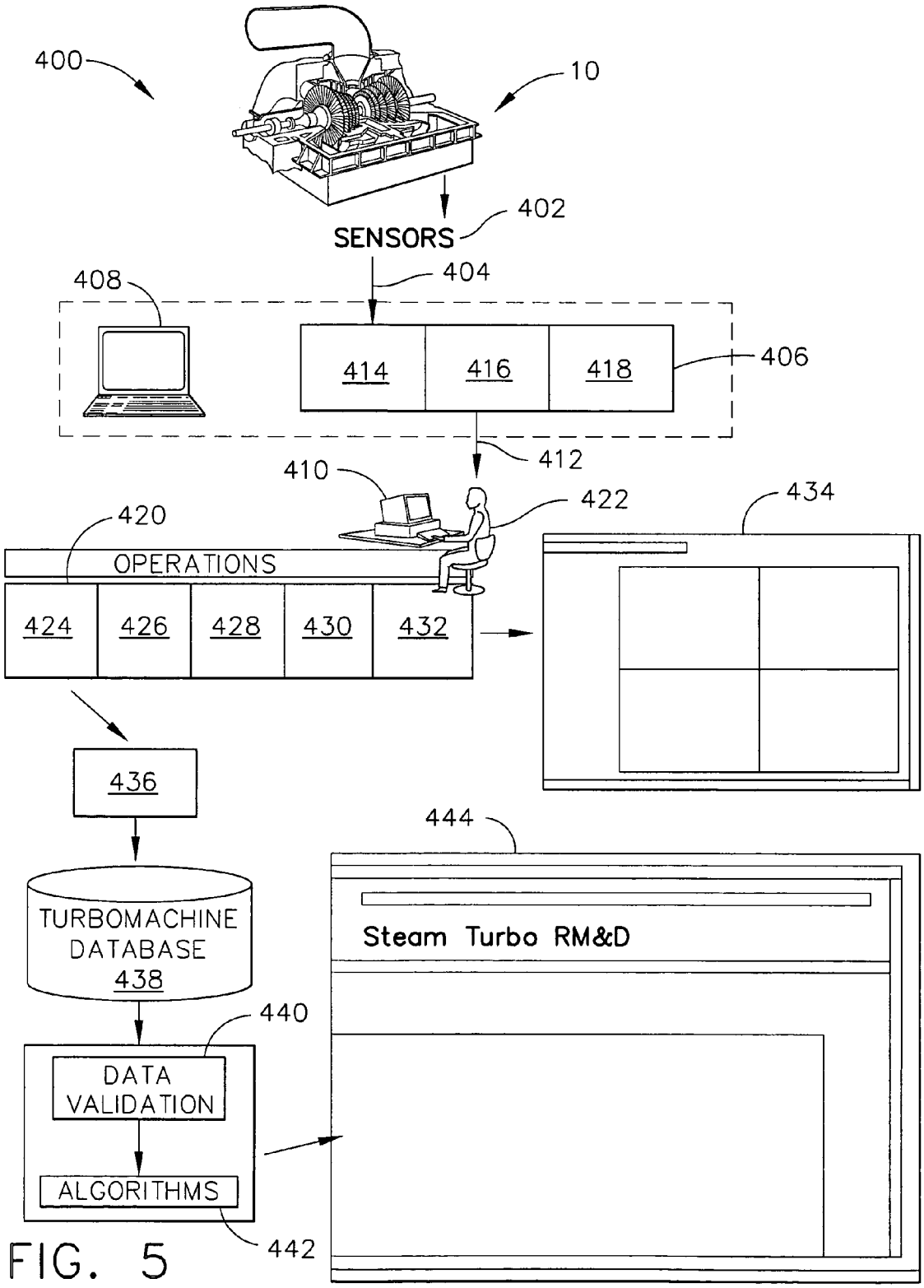
FIG. 5 is a simplified block diagram of an exemplary real-time steam turbine optimization system.

FIG. 5 is a simplified block diagram of an exemplary real-time steam turbine optimization system 400. As used herein, real-time refers to outcomes occurring at a substantially short period after a change in the inputs affecting the outcome, for example, computational calculations. The period is the amount of time between each iteration of a regularly repeated task. Such repeated tasks are called periodic tasks. The time period is a design parameter of the real-time system that may be selected based on the importance of the outcome and/or the capability of the system implementing processing of the inputs to generate the outcome. Additionally, events occurring in real-time, occur without substantial intentional delay. In the exemplary embodiment, calculations are updated in real-time with a periodicity of one second. A turbomachine, such as steam turbine 10 (shown in FIG. 1) may include a plurality of sensors 402 that are configured to monitor steam turbine 10 and equipment coupled to steam turbine 10. One or more signals 404 that are representative of sensed operating parameters, are transmitted from sensors 402 to an on site monitor (OSM) 406 or a plant distributed control system (not shown). On site monitor 406 may include a computer 408 and may be configured to be a client communicatively coupled with a server 410 via a communications link 412, such as, but, not limited to the Internet or a Intranet through a phone connection using a modem and telephone line, a network (e.g., LAN, WAN, etc.) connection, or a direct point to point connection using modems, satellite connection, direct port to port connection utilizing infrared, serial, parallel, USB, FireWire/IEEE-1394. In another embodiment, on site monitor 406 may include a controller unit for steam turbine 10. Portions of OSM 406 may include a data collection and storage portion 414, an anomaly detection portion 416, and a remote notification portion 418.

Server 410 may include a remote monitoring and diagnostics workstation 420 may be coupled to server 410 as an integral component, as illustrated in the exemplary embodiment, or may be a client of server 410. Remote monitoring and diagnostics workstation 420 may be located in a central operations center (not shown) and include a more robust analytical software suite than may be available in OSM 406. Remote monitoring and diagnostics workstation 420 may also receive data transmitted from a plurality of sites where customer, third party, and/or client turbomachines may be monitored. Accordingly, turbomachine real-time operating data and archival data for a fleet of turbomachines may be available to remote monitoring and diagnostics workstation 420. A user 422 may have available several components of remote monitoring and diagnostics workstation 420, such as, but, not limited to, a data retrieval and archiving component 424, a data calculation component 426, an anomaly detection component 428, a diagnostic assessment component 430, and a data visualization and reporting component 432. Data visualization and reporting component 432 may include a plurality of user interfaces 434 to facilitate analyzing data. Data retrieval and archiving component 424 may be coupled to an automated data retrieval unit 436 that samples data from data retrieval and archiving component 424 at a selectable rate, for example, every minute, and stores the data for later retrieval and analysis. Data from automated data retrieval unit 436 may be transmitted to a turbomachine database 438 that may include operating data from a fleet of turbomachines and design and maintenance history data for the fleet of turbomachines. The comprehensive data archive permits the algorithms of embodiments of the present invention to analyze historical data to facilitate improving an accuracy of the algorithms across a wide variety of applications. The data may be validated 440 and applied to algorithms that may learn the operating characteristics of each monitored turbomachine and to determine, over time, the least restrictive set of operating parameter values that define an off normal operating condition, so that, each turbine may be afforded protection from rubs occurring while maintaining substantial operational capability. A user interface 444 may be used to control and modify the algorithms and the data archival process.

Data that may be used by real-time steam turbine optimization system 400 to determine an off-normal operating condition that may lead to a rub may be available using standard and common operational data that may already be communicated to on site monitor 406. Such operational data may be obtained from previously installed sensors. In the exemplary embodiment, on site monitor 406 monitors bearing vibration (peak-to-peak displacement), temperature, pressure, eccentricity, axial displacement, load, and condenser pressure values. Off-normal operating conditions that may lead to a rub condition are monitored in near real time, remotely, with peak-to-peak vibration signals, and by monitoring automatic event correlation, for example, conditions that may lead to a rub if steam turbine 10 were permitted to startup and/or continue operations.

The operational data discussed above may be obtained from signals 412 communicated by sensors 402 related to the operation of steam turbine 10. Sensors 412 include vibration sensors which measure radial vibration near bearings of steam turbine 10. Vibration sensors may include, but are not limited to, eddy current probes, accelerometers, or vibration transducers. When reference is made to a low pressure bearing vibration, this is the radial vibration measurement taken on the bearing nearest the low pressure side of steam turbine 10, typically near the outlet end. There are also axial vibration sensors, which measure the axial movement of rotor portions 43, 44, and 60. Shaft eccentricity may be measured by sensors 412 to determine when a combination of slow roll and heating have reduced the rotor eccentricity to the point where the turbine can safely be brought up to speed without damage from excessive vibration or rotor to stator contact. Eccentricity is the measurement of rotor bow at rotor slow roll which may be caused by, but not limited to, any or a combination of: fixed mechanical bow; temporary thermal bow; and gravity bow. Usually eddy current probes are used to measure shaft eccentricity. Differential expansion measures turbine rotor expansion in relation to the turbine shell, or casing. Differential expansion may be measured using eddy current probes or linear voltage differential transformers (LVDT). Other operating conditions that mat be measured include shell metal temperature and steam inlet temperature, that may be measured by temperature transducers such as thermocouples. Condenser pressure may be measured by pressure transducers. The on site monitor 406 may include a storage medium encoded with a machine-readable computer program code for detecting off-normal operating conditions that may lead to a rub in steam turbine 10 using inputs from sensors 402. The computer program code may include instructions for causing a computer to implement the embodiments of the disclosed method described below.

Figure 6:
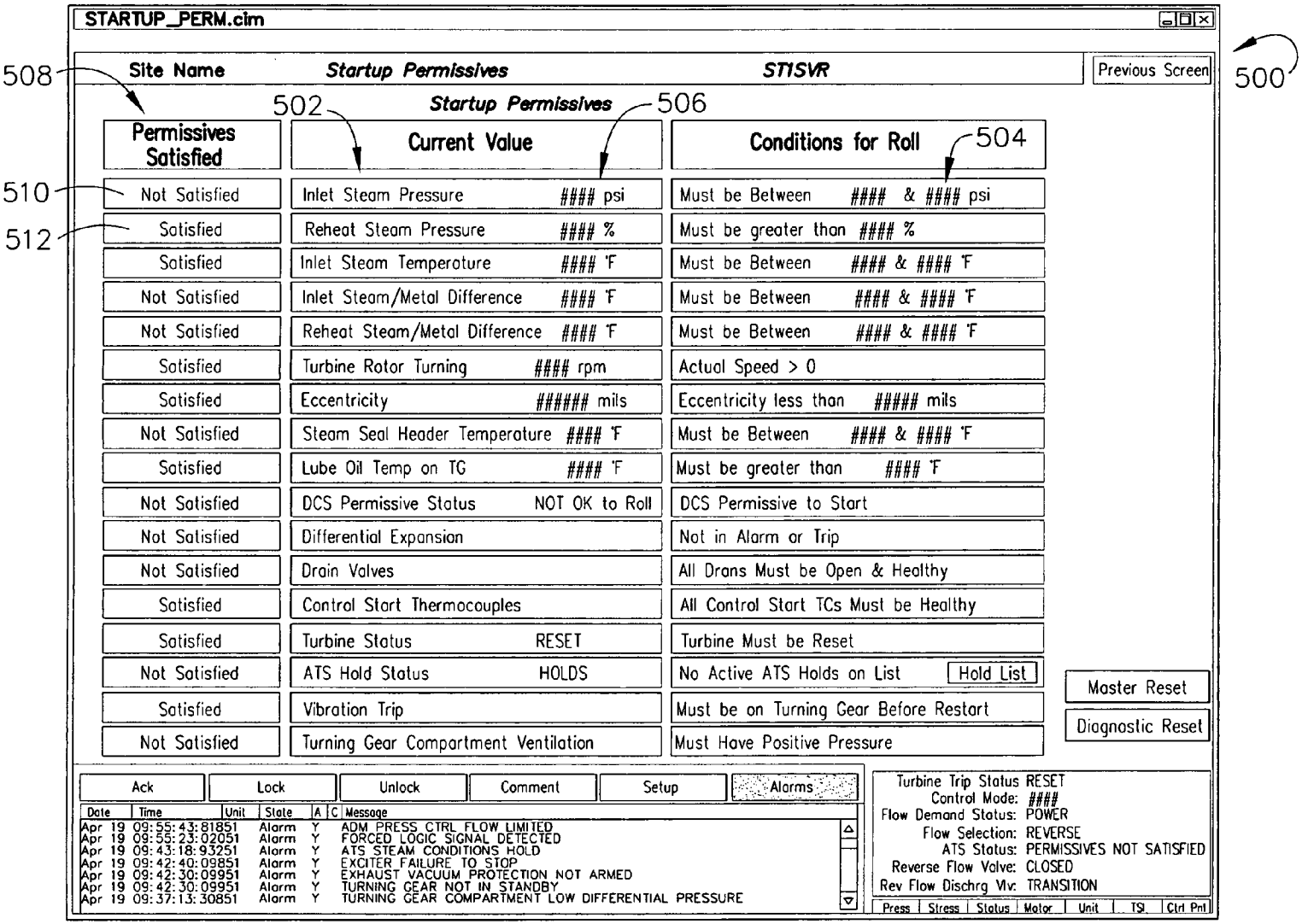
FIG. 6 is an exemplary embodiment of a user interface displaying a start permissives page within real-time steam turbine optimization system.

FIG. 6 is an exemplary embodiment of a user interface 500 displaying a start permissives page within real-time steam turbine optimization system 400. In the exemplary embodiment, steam turbine optimization system 400 includes algorithms that receive data from OSM 406, analyze the data for predetermined relationships between monitored plant conditions and plant conditions wherein the probability of turbomachine rubs is likely, or wherein turbomachine rubs have been observed in the past, for example, through analysis of archival data stored in database 420 or other location. The monitored plant conditions are sensed by sensors 412, transmitted to OSM 406 or to the DCS, and then made accessible to steam turbine optimization system 400.

User interface 500 includes a display of monitored parameters 502 that are determined to contribute to conditions that facilitate packing seal rubs such that, conditions that lead to packing seal rubs are avoided by limiting the monitored parameters that contribute to onset of those conditions to allowable values or ranges of values 504. The allowable ranges may be determined based on design requirements and or empirical study and may be unique to different turbine units in a fleet of turbines. Allowable ranges may also be variable based on plant operating history. For example, for a startup of a turbine from cold iron conditions, a steam admission temperature to turbine metal differential temperature may be limited to a lesser value than when the turbine is re-started a short time after a trip. Various off-normal operating conditions of the turbine may increase the likelihood of packing 52, 30, and 32 contacting rotor shaft portions 43, 44 and 60.

Display of monitored parameters 502 includes a current value 506 of each of the monitored parameters. User interface 500 includes a permissives satisfied indication 508 that may be colored coded to provide visual cues to an operator a to the condition of the plant, and in particular, to the monitored parameters that contribute to the conditions that facilitate packing seal rubs. For example, a "satisfied" condition 510 may be color-coded "green", whereas a "not satisfied" condition 512 may be color-coded "red". User interface 500 may include a means to select other DCS control screens, such as, by graphical software buttons (not shown).

Various off-normal operating conditions of the turbine may initiate turbine vibrations or increase the magnitude and/or phase of existing vibrations in the turbine. Such vibrations may increase the likelihood of rotor shaft portions 43, 44 and 60 contacting shaft steam seal packing 30, 32, and 52, respectively. Off-normal operating conditions such as, but, not limited to, temperature differentials between inlet steam temperature and turbine rotor metal temperatures, temperature differentials between inlet steam temperature and turbine casing metal temperatures, eccentricity of the rotor due to bowing, steam seal temperature outside a predetermined operating range, axial movement of the rotor and/or casing or differential movement between the rotor and the casing, and water induction into the turbine may be sources of changes in the vibration of the turbine that may cause teeth 80 to contact shaft portions 43, 44 and/or 60.

Figure 7:
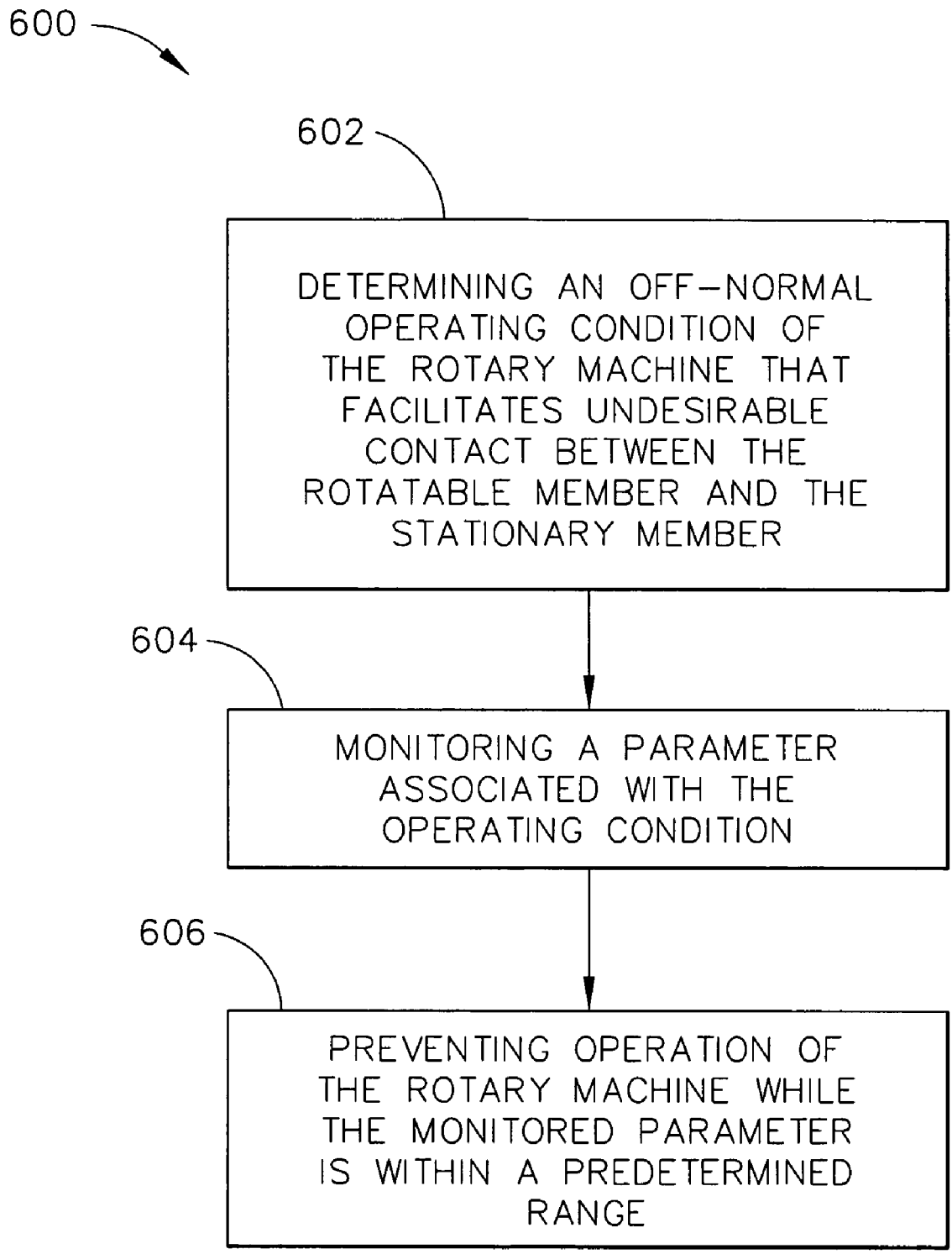
FIG. 7 is a flowchart of an exemplary method that may be used to operate the turbine shown in FIG. 1.

FIG. 7 is a flowchart of an exemplary method 600 that may be used to operate turbine 10 (shown in FIG. 1). Method 600 includes determining 602 an off-normal operating condition of turbine 10 wherein the off-normal operating condition facilitates undesirable contact, or rubs, between labyrinth seal teeth 80 coupled to rotor shaft portions 43, 44, and 60 and labyrinth seal teeth 82 coupled to casing 16.

Off-normal operating conditions that may cause and/or contribute to rubs are those that can drive rotor components into casing components, such as driving teeth 80 into teeth 82. The contact may be intermittent, such as by vibratory motion of the rotor components, or may be substantially constant, such as when rotor components move in relation to casing components, for example, when there is differential expansion between rotor components and casing components. Such off-normal operating conditions may include a bowed rotor wherein the longitudinal axis of the rotor is not linear, or is at least partially arcuate. A rotor, which has been idle or has been inadvertently stopped for an extended period may develop a bow or bend. The bow may be corrected by turning gear operation and, possibly, with auxiliary heating prior to high speed operation to prevent internal clearance rubbing. Shaft eccentricity measurements are used to determine when a combination of slow roll and heating have reduced the rotor eccentricity to the point where the turbine can safely be brought up to speed without damage from excessive vibration or rotor to casing contact. Eccentricity is the measurement of rotor bow at rotor slow roll that may be caused by any, or a combination of fixed mechanical bow, temporary thermal bow, and/or gravity bow. A sudden trip of the unit and failure of the turning gear to engage may cause thermal/gravity bow.

Additionally, a shell expansion measurement is utilized to monitor the thermal growth of the turbine shell or casing 16 during startup, operation, and shutdown. Casing 16 is anchored to a turbine foundation at one end of the machine and allowed to expand or grow by sliding towards the opposite end. The expansion or growth of the casing expansion is the measurement of how much the turbine's shell expands or grows as it is heated, in some case up to several inches.

During turbine run-ups, run-downs, and introduction of steam at a differential temperature from the turbine metal portions may cause thermal conditions to change such that the turbine's rotor and casing may expand and/or contract at different rates. A differential expansion measurement permits assessment of the relative growth or contraction between these rotary machine members to facilitate preventing rubs from occurring.

A rate of acceleration parameter may be monitored during startup as an indication of torque applied to the rotor. Acceleration rate measurement sensor may use a turbine speed input to derive its output. Phase, or phase angle, is a measure of the relationship between vibration signals and be used to determine changes in the rotor balance condition, or deviations in rotor system stiffness, such as a cracked shaft.

Other off-normal operating conditions that may contribute to a vibratory reaction from turbine 10 are relatively low steam seal header temperature and/or lubrication oil temperature, turbine drain valves, or traps that are not operating properly to remove condensed steam from the turbine. Each off-normal operating condition may have a particular group of plant process sensors that may be used to sense parameters that correlate to each off-normal operating condition with a relatively high degree of confidence. For example, a differential expansion sensor, an inlet steam sensor, and a turbine metal temperature sensor may be used cooperatively to indicate a degree to which casing 16 may be expanding relative to the rotor components. Such a degree of differential expansion may not be tolerable given the clearances available between teeth 80 and 82. A determination may be programmed into the algorithms of system 400 that sets an allowable operating range for each of the process parameters utilized in determining the off-normal operating condition of turbine 10. The allowable operating range may be variable based on the operating history of turbine 10. For example, temperature differential operating limits may be different when turbine 10 is in a startup from cold iron condition than when turbine 10 is restarting after a trip. Each of the parameters associated with each off-normal operating condition is monitored 604 and the magnitude and direction of change of the magnitude may be analyzed relative to each other parameter associated with the off-normal operating condition, such that the off-normal operating condition of turbine 10 is identified. Such an analysis avoids overly conservative allowable ranges of parameter magnitudes that may limit startup and/or operating flexibility. The monitored parameters are then compared to the determined allowable ranges for the parameters. Monitored parameters that indicate turbine 10 is approaching an off-normal operating condition wherein the rotor components may rub may be used to annunciate an alarm condition. During startup, monitored parameters may be used to set control system permissives when the monitored parameter is within the determined allowable range. The permissive may control a steam inlet valve block, such that until all permissives are met, the inlet control valve is prevented from allowing steam admission into the turbine, or the steam flow may be limited to an amount useful for warming turbine 10. Operation of turbine 10 may be prevented 606 while the monitored parameters are within a predetermined range, or outside a predetermined allowable range.

A technical effect produced by the system includes optimizing turbine startups such that off-normal operating conditions that facilitate initiating and/or aggravating vibration of the turbine may be avoided. Off-normal operating conditions to be avoided may be determined using a combination of turbine design data and real-time process parameter data for parameters that are associated with the off-normal operating conditions to be avoided. Moreover, avoiding corrective actions for vibrations facilitates faster unit startup and ascension to revenue producing operation. Algorithms programmed into the memory of a processor may then be executed to prevent operation of turbine 10 when turbine 10 is in the off-normal operating condition.

Although the invention is herein described and illustrated in association with a turbine for a steam turbine engine, it should be understood that the present invention may be used for optimizing a startup of any rotary machine. Accordingly, practice of the present invention is not limited to steam turbine engines.

The above-described real-time steam turbine optimization systems provide a cost-effective and reliable means for starting up a rotary machine. More specifically, the system monitors parameters in real-time and blocks operation of the turbine until off-normal operating conditions that may facilitate the rotor components undesirably contacting the casing components are no longer present. Accordingly, the real-time steam turbine optimization system provides a cost-effective method of operating a rotary machine.

Exemplary embodiments of a real-time steam turbine optimization system are described above in detail. The real-time steam turbine optimization system components illustrated are not limited to the specific embodiments described herein, but rather, components of each real-time steam turbine optimization system may be utilized independently and separately from other components described herein. For example, the real-time steam turbine optimization system components described above may also be used in combination with other control systems, such as, distributed control systems (DCS), turbine supervisory instrument systems (TSI), steam turbine control systems, and turbine protective systems.

While the invention has been described in terms of various specific embodiments, those skilled in the art will recognize that the invention can be practiced with modification within the spirit and scope of the claims.

What is claimed is:

1. A method for operating a rotary machine including a stationary member and a rotatable member, wherein the rotatable member rotates at least partially within the stationary member, said method comprising:

determining an off-normal operating condition of the rotary machine that facilitates undesirable contact between the rotatable member and the stationary member due to at least one of an operating operation that increases a reheat steam temperature to stationary member metal temperature differential to a value that is greater than a predetermined value, an operating operation that increases an inlet steam temperature to stationary member metal temperature differential to a value that is greater than a predetermined value, and a bow in a longitudinal axis of the rotatable member;

monitoring a parameter associated with the off-normal operating condition; and preventing operation of the rotary machine while the monitored parameter is within a predetermined range.

2. A method in accordance with claim 1 wherein determining an off-normal operating condition of the rotary machine comprises determining an off-normal operating condition of the rotary machine that initiates a rotary machine vibration above a predetermined threshold or increases a severity of vibration of the rotary machine.

3. A method in accordance with claim 1 wherein determining an off-normal operating condition of the rotary machine comprises determining an off-normal operating condition of the rotary machine during a rotary machine startup procedure.

4. A method in accordance with claim 1 wherein determining an off-normal operating condition of the rotary machine comprises determining at least one of a distortion of the rotatable member and a distortion of the stationary member.

5. A method in accordance with claim 1 wherein monitoring a parameter associated with the off-normal operating condition comprises monitoring at least one of a rotary machine bearing vibration level, a rotatable member vibration phase angle, a stationary member expansion, a stationary member to rotatable member differential expansion, a steam inlet valve position, a rotary machine drain valve position, a rotary machine speed and acceleration, a rotatable member thrust position, a rotatable member eccentricity, at least one bearing temperature, and at least one bearing oil temperature.

6. A method in accordance with claim 1 wherein monitoring a parameter associated with the off-normal operating condition comprises receiving a signal relative to the monitored parameter from a plant distributed control system.

7. A method in accordance with claim 1 further comprising determining an operating history of the rotary machine to enable the predetermined range to be selected based on the operating history.

8. A method in accordance with claim 7 further comprising determining an operating history of the rotary machine from an operating history of at least one other rotary machine in a fleet of substantially similar rotary machines.

9. A method in accordance with claim 1 further comprising limiting the rotary machine output to facilitate maintaining the monitored parameter is within the predetermined range.

10. A method in accordance with claim 1 wherein preventing operation of the rotary machine comprises substantially preventing main steam flow into the rotary machine.

11. A method in accordance with claim 1 wherein preventing operation of the rotary machine comprises transmitting a steam inlet valve block signal to a rotary machine control system.

12. A method in accordance with claim 1 further comprising displaying a current value of the monitored parameter.

13. A method in accordance with claim 12 further comprising displaying a desirable range of values for the monitored parameter.

14. A method in accordance with claim 12 further comprising displaying whether the monitored parameter is within a desirable range of values for the monitored parameter.

15. A control system to facilitate optimizing turbine startup procedures for a turbine that includes a turbine shell and a rotor that is configured to rotate about a longitudinal axis at least partially within the shell; said control system comprising:

a plurality of process sensors that are configured to monitor an off-normal operating condition of the turbine a database for storing turbine design data relating to clearances defined between the rotor and the shell; and a processor comprising a memory storing a plurality of analytical tools, said processor configured to be coupled to said plurality of process sensors and said database, said processor further configured to:

determine an off-normal operating condition of the rotary machine wherein the off-normal operating condition facilitates undesirable contact between the rotatable member and the stationary member;

monitor a parameter associated with the off-normal operating condition; and at least one of prevent operation of the rotary machine while the monitored parameter is within a predetermined range, limit the rotary machine output to facilitate maintaining the monitored parameter is within the predetermined range, and reduce the rotary machine output to facilitate maintaining the monitored parameter is within the predetermined range.

16. A control system according to claim 15 wherein said processor is further configured to determine an off-normal operating condition of the rotary machine that initiates a rotary machine vibration above a predetermined threshold or increases a severity of vibration of the rotary machine.

17. A control system according to claim 15 wherein said processor is further configured to determine an operating operation that increases a reheat steam temperature to stationary member metal temperature differential to a value greater than a predetermined value, or increases an inlet steam temperature to stationary member metal temperature differential to a value greater than a predetermined value.

18. A control system according to claim 15 wherein said processor is further configured to determine a bow in a longitudinal axis of the rotatable member.

19. A control system according to claim 15 wherein said processor is further configured to determine an off-normal operating condition of the rotary machine during a rotary machine startup procedure.

20. A control system according to claim 15 wherein said processor is further configured to determine at least one of a distortion of the rotatable member and the stationary member.

21. A control system according to claim 15 wherein said processor is further configured to monitor a rotary machine bearing vibration level, a rotatable member vibration phase angle, a stationary member expansion, a stationary member to rotatable member differential expansion, a steam inlet valve position, a rotary machine drain valve position, a rotary machine speed and acceleration, a rotatable member thrust position, a rotatable member eccentricity, at least one bearing temperature, and at least one bearing oil temperature.

22. A control system according to claim 15 wherein said processor is further configured to receive a signal relative to the monitored parameter from a plant distributed control system.

23. A control system according to claim 15 wherein said processor is further configured to determine the operating history of the rotary machine to enable the predetermined range to be selected based on at least one of the operating history of the rotary machine and an operating history of at least one other rotary machine in a fleet of substantially similar rotary machines.

24. A control system according to claim 15 wherein said processor is further configured to substantially prevent main steam flow into the rotary machine, to substantially limit main steam flow into the rotary machine, and to control main steam flow into the rotary machine.

25. A control system according to claim 15 wherein said processor is further configured to transmit a steam inlet valve block signal to a rotary machine control system to prevent operation of the rotary machine while the monitored parameter is within a predetermined range.

26. A control system according to claim 15 wherein said processor is further configured to display a current value of the monitored parameter.

27. A control system according to claim 15 wherein said processor is further configured to display a desirable range of values for the monitored parameter.

28. A control system according to claim 15 wherein said processor is further configured to display whether the monitored parameter is within a desirable range of values for the monitored parameter.

29. A computer program embodied on a computer readable medium for monitoring a plant, the plant having a plurality of equipment cooperating to supply steam to a steam driven rotary machine, said rotary machine comprising a stationary member and a rotatable member that is configured to rotate at least partially within the stationary member, said program comprising a code segment that controls a computer that receives a plurality of process parameters from sensors operatively coupled to the equipment and then:

determines an off-normal operating condition of the rotary machine wherein said off-normal operating condition facilitates undesirable contact between the rotatable member and the stationary member;

monitors a parameter associated with the off-normal operating condition; and prevents operation of the rotary machine while the monitored parameter is within a predetermined range.

30. A computer program in accordance with claim 29 further comprising at least one code segment that determines an off-normal operating condition of the rotary machine wherein the normal operating condition at least one of initiates a rotary machine vibration above a predetermined threshold and increases a severity of vibration of the rotary machine.

31. A computer program in accordance with claim 29 further comprising at least one code segment that determines an off-normal operating operation wherein the off-normal operating condition at least one of increases a reheat steam temperature to stationary member metal temperature differential to a value greater than a first predetermined value, and increases an inlet steam temperature to stationary member metal temperature differential to a value greater than a second predetermined value.

32. A computer program in accordance with claim 29 further comprising at least one code segment that determines a bow in a longitudinal axis of the rotatable member.

33. A computer program in accordance with claim 29 further comprising at least one code segment that determines an off-normal operating condition of the rotary machine during a rotary machine startup procedure.

34. A computer program in accordance with claim 29 further comprising at least one code segment that determines at least one of a distortion of the rotatable member and the stationary member.

35. A computer program in accordance with claim 29 further comprising at least one code segment that monitors a rotary machine bearing vibration level, a rotatable member vibration phase angle, a stationary member expansion, a stationary member to rotatable member differential expansion, a steam inlet valve position, a rotary machine drain valve position, a rotary machine speed and acceleration, a rotatable member thrust position, a rotatable member eccentricity, at least one bearing temperature, and at least one bearing oil temperature.

36. A computer program in accordance with claim 29 further comprising at least one code segment that receives a signal relative to the monitored parameter from a plant distributed control system.

37. A computer program in accordance with claim 29 wherein the predetermined range is variable based on an operating history of the rotary machine, and wherein said computer program further comprises at least one code segment that determines the operating history of the rotary machine.

38. A computer program in accordance with claim 29 further comprising at least one code segment that substantially prevents main steam flow into the rotary machine.

39. A computer program in accordance with claim 29 further comprising at least one code segment that transmits a steam inlet valve block signal to a rotary machine control system to prevent operation of the rotary machine while the monitored parameter is within a predetermined range.

40. A computer program in accordance with claim 39 further comprising at least one code segment that displays a current value of the monitored parameter.

41. A computer program in accordance with claim 39 further comprising at least one code segment that displays a desirable range of values for the monitored parameter.

42. A computer program in accordance with claim 39 further comprising at least one code segment that displays whether the monitored parameter is within a desirable range of values for the monitored parameter.

* * * * *